US007632539B2

(12) United States Patent
Miyake

(10) Patent No.: US 7,632,539 B2
(45) **Date of Patent: *Dec. 15, 2009**

(54) METHOD FOR MANUFACTURING PHOTOCONDUCTIVE LAYERS THAT CONSTITUTE RADIATION IMAGING PANELS

(75) Inventor: Kiyoteru Miyake, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 670 days.

This patent is subject to a terminal disclaimer.

(21) Appl. No.: 11/087,664

(22) Filed: Mar. 24, 2005

(65) Prior Publication Data

US 2005/0214451 A1 Sep. 29, 2005

(30) Foreign Application Priority Data

Mar. 24, 2004 (JP) ..... 2004-086146

(51) Int. Cl.
*B05D 5/12* (2006.01)

(52) U.S. Cl. ..... 427/160; 427/2.11; 427/65; 427/421.1

(58) Field of Classification Search ..... 427/160, 427/2.13, 421.1, 2.11, 65
See application file for complete search history.

(56) References Cited

U.S. PATENT DOCUMENTS

| | | | | |
|---|---|---|---|---|
| 4,475,032 | A * | 10/1984 | Popma et al. | 250/214 VT |
| 5,455,138 | A * | 10/1995 | Okamura et al. | 430/128 |
| 6,512,233 | B1 | 1/2003 | Sato et al. | |
| 6,774,385 | B2 | 8/2004 | Imai | |
| 2004/0026030 | A1 * | 2/2004 | Hatono et al. | 156/279 |

FOREIGN PATENT DOCUMENTS

JP 2000-249769 A 9/2000

OTHER PUBLICATIONS

Morell et al;, "Sintering of an X-Ray Photosensitive Ceramic"; The Ceramic Society of Japan; Handbook of Ceramics; vol. 58; pp. 613-615; 1979.*

* cited by examiner

*Primary Examiner*—Frederick J Parker
*Assistant Examiner*—Jimmy Lin
(74) *Attorney, Agent, or Firm*—Sughrue Mion, PLLC

(57) ABSTRACT

$Bi_{12}MO_{20}$ material particles with a diameter of 0.1 to 2 μm, which are filled in an aerosolization chamber, are shaken/agitated together with carrier gas in a high-pressure gas cylinder which stores the carrier gas, thereby being aerosolized. The aerosolized $Bi_{12}MO_{20}$ material particles are injected together with the carrier gas onto a substrate from a nozzle in a film-forming chamber, the nozzle including a narrow opening, and the $Bi_{12}MO_{20}$ material particles are deposited onto the substrate, thereby being formed into a film.

1 Claim, 6 Drawing Sheets

FIG.1
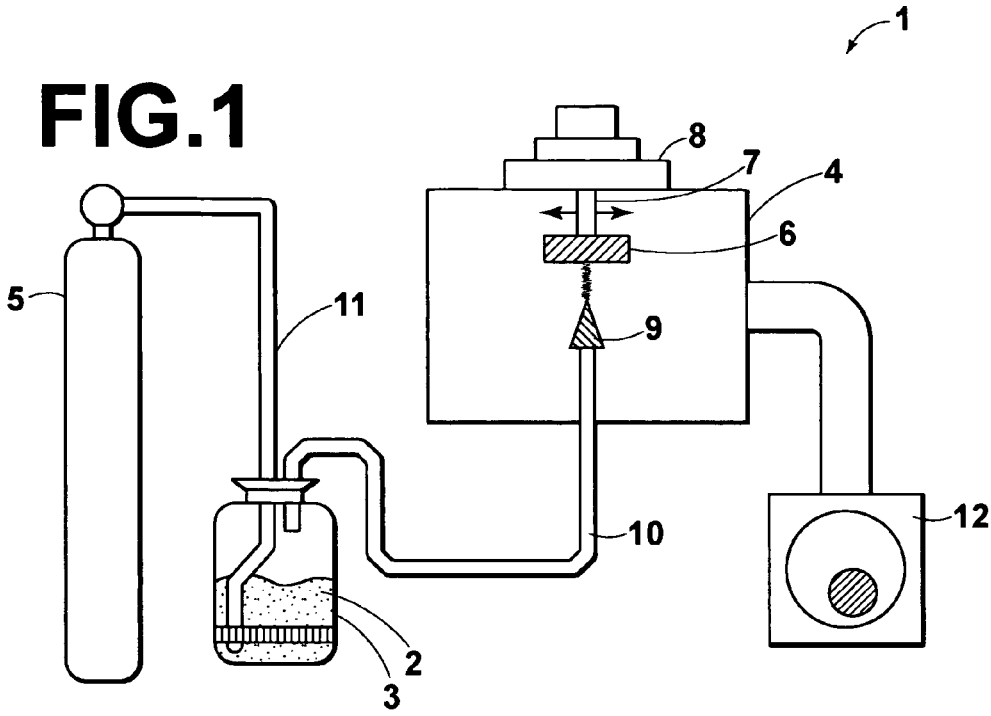
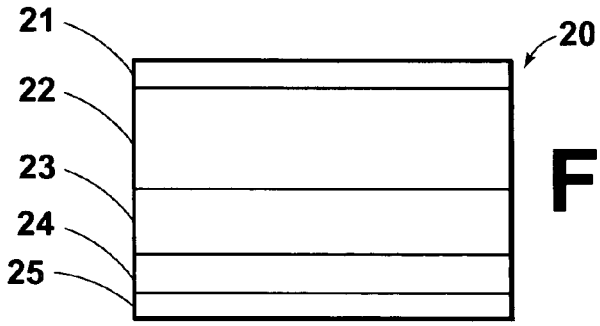
FIG.2
FIG.3
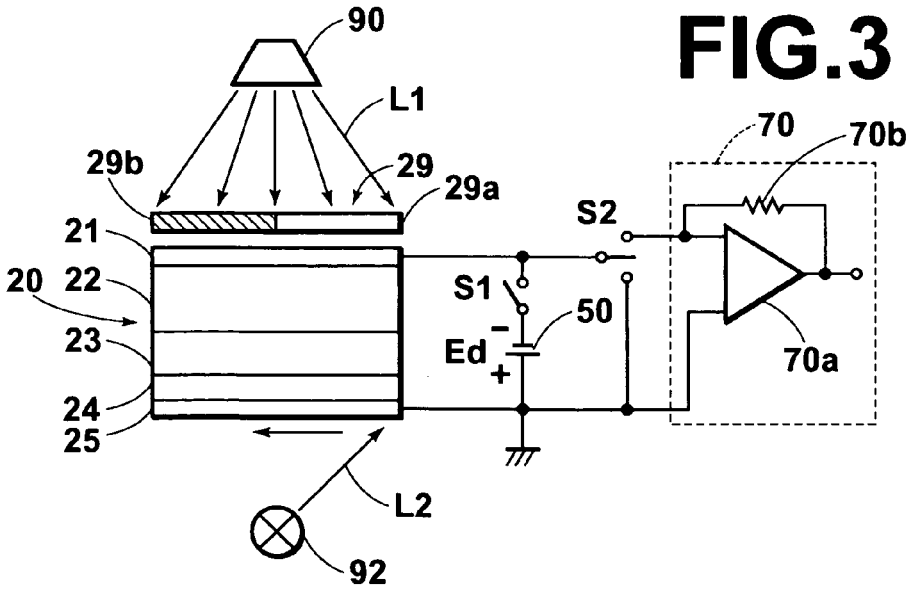

METHOD FOR MANUFACTURING PHOTOCONDUCTIVE LAYERS THAT CONSTITUTE RADIATION IMAGING PANELS

BACKGROUND OF THE INVENTION

1. Field of the Invention

The present invention relates to a radiation imaging panel suitable for application to a radiation imaging apparatus using X-rays and the like and, specifically, relates to a method for manufacturing a photoconductive layer that constitutes the radiation imaging panel.

2. Description of the Related Art

Heretofore, in medical X-ray imaging, an X-ray imaging panel has been known, which uses a photoconductive layer sensitive to X-rays as a photosensitive member for the purpose of reducing a dose of radiation to which a subject is exposed, improving diagnostic performance, and so on. The X-ray imaging panel reads an electrostatic latent image formed on the photoconductive layer by the X-rays by means of light or a large number of electrodes, and records the image thus read. A method using the X-ray imaging panel is superior in that resolution thereof is higher than indirect radiography by a television camera tube, which is a well-known imaging method.

The above-described X-ray imaging panel is constituted to generate charges corresponding to X-ray energy by irradiating a charge generation layer provided therein with X-rays, and to read the generated charges as electric signals. The above-described photoconductive layer acts as the charge generation layer.

Heretofore, as a method for manufacturing the photoconductive layer, a vacuum evaporation method, a coating method and a single crystal method have been widely and commonly known. A photoconductive layer manufactured by the vacuum evaporation method is highly sensitive (for example, refer to U.S. Pat. Nos. 6,774,385 and 6,512,233). The coating method is superior in terms of manufacturing costs (for example, refer to Japanese Unexamined Patent Publication No. 2000-249769). A photoconductive layer manufactured by the single crystal method is superior in sensitivity, as in the vacuum evaporation method.

However, though such high sensitivity can be realized, the photoconductive layer manufactured by the vacuum evaporation method has problems that the manufacturing cost thereof is high, and that it is not necessarily possible to manufacture the photoconductive layer itself to have a desired composition, depending on the type of a material constituting the photoconductive layer, for example, a complex oxide. Meanwhile, though being superior in terms of the manufacturing costs, the photoconductive layer manufactured by the coating method has problems that image granularity is poor and sensitivity is low because the movement of the generated charges is inhibited owing to a binder, and because electric noise is increased. Moreover, in the single crystal method, the manufacturing costs of the photoconductive layer are high, and further, enlargement of an area thereof for the purpose of putting the photoconductive layer into practical use is technically difficult, and accordingly, the single crystal method is unsuitable for practical use.

SUMMARY OF THE INVENTION

The present invention has been made in consideration of the circumstances as described above. It is an object of the present invention to provide a method for manufacturing a photoconductive layer, which is capable of realizing a high sensitivity, a large area and low cost in the photoconductive layer.

A method for manufacturing a photoconductive layer according to the present invention is a method for manufacturing a photoconductive layer that constitutes a radiation imaging panel which records radiation image information as an electrostatic latent image, characterized in that material particles of the photoconductive layer are mixed with carrier gas, accelerated and injected by the carrier gas, and deposited on a substrate, thereby being formed into a film.

The photoconductive layer can be formed of $Bi_{12}MO_{20}$ (where M is at least one of Ge, Si and Ti. Hereinafter, these remarks will be omitted). It is preferable that a particle diameter distribution of the material particles of the photoconductive layer be set so that particles with a particle diameter of 0.1 to 2 μm occupy 50 wt % or more. Moreover, it is preferable that the temperature of the substrate when the material particles of the photoconductive layer are deposited be within a range from 100° C. to 300° C. Note that it is preferable that the temperature of the substrate when the material particles of the photoconductive layer are deposited on a substrate having one or plural electrodes be within a range from 10° C. to 200° C.

Amorphous selenium (a-Se), which has been heretofore used in general as a material of the photoconductive layer, has low X-ray absorptivity. Accordingly, it is necessary that the thickness of the photoconductive layer be formed large (for example, 500 μm or more). However, when film thickness is increased in such a manner, the reading speed of the latent image is lowered. In addition, high voltage is applied to the photoconductive layer at least during a period from the start of reading the latent image to the end thereof after the latent image is formed. Accordingly, charges caused by dark current are added, which thereby decrease contrast in a low-dose range. Moreover, noise (structure noise) resulting from variations in geometric accuracy of the thickness direction of Se is prone to be picked up. As described above, a-Se has had problems in use. Accordingly, a complex oxide such as $Bi_{12}MO_{20}$ has been studied as material of the photoconductive layer other than a-Se. However, it has been difficult to form the complex oxide into a film by the vacuum evaporation method, and accordingly, the coating method has been used to manufacture the photoconductive layer. Thus, there have been problems such as the lowering of the sensitivity, which are described above.

In the method for manufacturing a photoconductive layer according to the present invention, the material particles of the photoconductive layer are mixed with the carrier gas, accelerated and injected by the carrier gas, and deposited on the substrate, thereby being formed into a film. Accordingly, it is possible to manufacture the photoconductive layer, whatever the type of material constituting the photoconductive layer may be. In particular, it becomes possible to manufacture the photoconductive layer formed of the complex oxide such as $Bi_{12}MO_{20}$, which cannot be manufactured by the vacuum evaporation method.

Moreover, in the method for manufacturing a photoconductive layer according to the present invention, the material particles of the photoconductive layer are mixed with the carrier gas, accelerated and injected by the carrier gas, and deposited on the substrate, thereby being formed into a film. Accordingly, a binder is not required as in the coating method. Therefore, it is possible to obtain a dense film body having the same composition as that of the material particles. Moreover, an effect of inhibiting a movement of the generated charges, which is caused by the binder, is restricted, thus making it possible to reduce the electric noise. Furthermore, the image granularity is improved, thus making it possible to enhance the sensitivity.

Furthermore, the material particles of the photoconductive layer are mixed with the carrier gas, accelerated and injected by the carrier gas, and deposited on the substrate, thereby being formed into a film. Accordingly, it is possible to cope with the area enlargement of the photoconductive layer. In addition, manufacturing cost of the photoconductive layer can be restricted more than in the vacuum evaporation method and the single crystal method, thus making it possible to manufacture the X-ray imaging panel at low cost.

Note that a particle diameter distribution of the material particles of the photoconductive layer is set so that particles with a particle diameter of 0.1 to 2 μm occupy 50 wt % or more. In this manner, it becomes possible to densely deposit the material particles of the photoconductive layer on the substrate, thus making it possible to further enhance the sensitivity.

Moreover, the temperature of the substrate when the material particles of the photoconductive layer are deposited is set within a range from 100° C. to 300° C. Also in this manner, it becomes possible to densely deposit the material particles of the photoconductive layer on the substrate, thus making it possible to further enhance the sensitivity.

BRIEF DESCRIPTION OF THE DRAWINGS

FIG. 1 is a schematic diagram showing a manufacturing apparatus for use in a method for manufacturing a photoconductive layer according to the present invention.

FIG. 2 is a cross-sectional view showing an embodiment of a radiation imaging panel having the photoconductive layer manufactured by the manufacturing method according to the present invention.

FIG. 3 is a constitutional view schematically showing a recording/reading system using the radiation imaging panel.

DESCRIPTION OF THE PREFERRED EMBODIMENTS

Figure 4A:
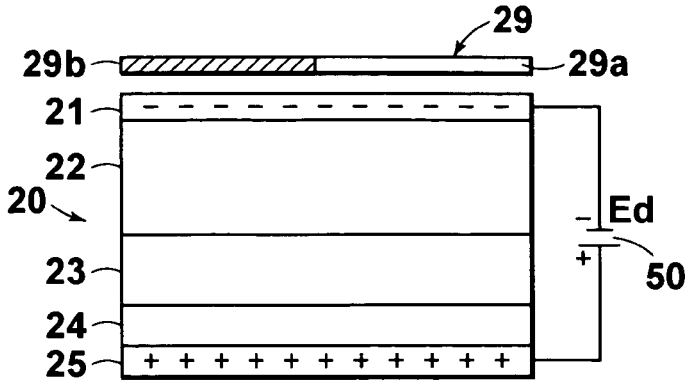
FIGS. 4A to 4D are views showing a process of recording an electrostatic latent image in the recording/reading system based on a charge model.

A method for manufacturing a photoconductive layer according to the present invention is a method for manufacturing a photoconductive layer that constitutes a radiation imaging panel, which records radiation image information as an electrostatic latent image, characterized in that material particles of the photoconductive layer are mixed with carrier gas, accelerated and injected by the carrier gas, and deposited on a substrate, thereby being formed into a film.

A film forming method in which the material particles of the photoconductive layer are mixed with the carrier gas, accelerated and injected by the carrier gas, and deposited on the substrate, thereby being formed into the film, that is, a so-called aerosol deposition method (AD method), is a technique in which a fine particulate or ultrafine particulate material prepared in advance is mixed with carrier gas, thereby being converted into aerosol. The obtained aerosol is injected through a nozzle onto a substrate, thereby being formed into a coating film. FIG. 1 is a schematic diagram showing a film-forming apparatus which performs the AD method for use in the manufacturing method of the present invention. The film-forming apparatus will be described by taking as an example the case of using $Bi_{12}MO_{20}$ as the material particles of the photoconductive layer.

A manufacturing apparatus 1 is formed of an aerosolization chamber 3 in which $Bi_{12}MO_{20}$ material particles 2 and carrier gas are agitated/mixed together, a film-forming chamber 4 in which film-formation is performed, and a high-pressure gas cylinder 5 which stores the carrier gas. Moreover, the film-forming chamber 4 includes a substrate 6 on which the $Bi_{12}MO_{20}$ material particles 2 are deposited, a holder 7 which holds the substrate 6, a stage 8 which operates the holder 7 three-dimensionally in XYZ directions and θ rotation angle, and a nozzle 9 which has a narrow opening and injects the $Bi_{12}MO_{20}$ material particles 2 onto the substrate 6. Furthermore, the manufacturing apparatus 1 includes a first pipe 10 which connects the nozzle 9 and the aerosolization chamber 3 to each other, a second pipe 11 which connects the aerosolization chamber 3 and the high-pressure gas cylinder 5 to each other, and a vacuum pump 12 which reduces pressure in the film-forming chamber 4.

The $Bi_{12}MO_{20}$ material particles 2 in the aerosolization chamber 3 are formed into a film on the substrate 6 in a procedure as described below. The $Bi_{12}MO_{20}$ material particles 2 filled in the aerosolization chamber 3 are shaken/agitated together with the carrier gas introduced from the high-pressure gas cylinder 5 which stores the carrier gas through the second pipe 11 into the aerosolization chamber 3, thereby being aerosolized. The $Bi_{12}MO_{20}$ material particles 2 thus aerosolized passes through the first pipe 10, are sprayed together with the carrier gas onto the substrate 6 from the nozzle 9 having the narrow opening in the film-forming chamber 4, and thus a coating film is formed. The film-forming chamber 4 is evacuated by the vacuum pump 12, and a degree of vacuum in the film-forming chamber 4 is adjusted as necessary. Moreover, the holder for the substrate 6 can move three-dimensionally by the XYZθ stage 8, and accordingly, a $Bi_{12}MO_{20}$ coating film with a required thickness is formed on a predetermined portion of the substrate 6.

For the material particles, it is preferable to use powder with a mean particle diameter ranging approximately from 0.1 to 10 μm, and more preferable to use one in which powder with a particle diameter of 0.1 to 2 μm occupies 50 wt % or more. Here, the particle diameter refers to an equivalent volume diameter which is a diameter of a ball having the same volume as the particle, and the mean is a number mean.

The aerosolized material particles are easily accelerated to a flow rate of 2 to 300 m/sec by being passed through the nozzle having the micro-opening of 6 $mm^2$ or less. The aerosolized material particles thus accelerated are made to collide with the substrate due to the carrier gas, and thus can be deposited on the substrate. The particles which have collided due to the carrier gas join together owing to an impact of the collision, thereby forming a film. Accordingly, a dense film is formed.

The temperature of the substrate when the material particles are deposited may be room temperature. However, in the case of using the $Bi_{12}MO_{20}$ material particles, it is possible to form a denser film by adjusting the temperature to 100° C. to 300° C.

Regarding the radiation imaging panel, there are those of a direct conversion type, which directly converts a radiation into charges and accumulates the charges converted, and those of an indirect conversion type, which converts the radiation once into light by a scintillator of CsI or the like, then converts the light into charges by an a-Si photodiode, and accumulates the charges thus converted. The photoconductive layer manufactured by the manufacturing method of the present invention is one used for the former radiation imaging panel, of the direct conversion type. Note that, besides the X-rays, a γ-ray, an α-ray and the like are usable as the radiation.

Moreover, the photoconductive layer manufactured by the manufacturing method of the present invention can be used for a so-called optical reading system which reads a radiation image by a radiation image detection unit utilizing a semiconductor material which generates charges by being irradiated with light. Furthermore, the photoconductive layer can be used for a system which accumulates charges generated by irradiation of the radiation and reads the accumulated charges by switching electrical switches on/off for each pixel such as thin film transistors (TFTs) (hereinafter, referred to as a TFT system).

First, as an example, a radiation imaging panel for use in the former optical reading system will be described. FIG. 2 is a cross-sectional view showing an embodiment of the radiation imaging panel including the photoconductive layer manufactured by the manufacturing method of the present invention.

The radiation imaging panel 20 is one formed by stacking, in the following order, a first conducting layer 21 which is transparent with respect to a recording radiation L1 to be described later, a recording radiation-conductive layer 22 which exhibits conductivity by receiving irradiation of the radiation L1 having being transmitted through the conductive layer 21, a charge transportation layer 23 which acts as a substantial insulator to charges (charges of a latent image polarity; for example, negative charges) charged in the conductive layer 21 and acts as a substantial conductor of charges (charges of a polarity in transportation; positive charges in the above-described example) reverse in polarity to the above-described charges, a reading photoconductive layer 24 which exhibits conductivity by receiving irradiation of reading light L2 to be described later, and a second conductive layer 25 which is transparent with respect to the reading light L2.

Here, as the conductive layers 21 and 25, for example, one (NESA film or the like) in which a conductive substance is evenly coated on a transparent glass plate is suitable. In the charge transportation layer 23, a larger difference between mobility of the negative charges charged in the conductive layer 21 and mobility of the positive charges reverse thereto in polarity is preferable. As the charge transportation layer 23, suitable is an organic compound such as poly(N-vinylcarbazole) (PVK), N,N'-diphenyl-N,N'-bis(3-methylphenyl)-[1,1'-biphenyl]-4, 4'-diamine (TPD) and discotic liquid crystal, a polymer (polycarbonate, polystyrene or PVK) dispersion, a semiconductor substance such as a-Se doped with Cl of 10 to 200 ppm, or the like. In particular, the organic compound (PVK, TPD, discotic liquid crystal or the like) is preferable because the organic compound has photo-insensitivity. Moreover, a dielectric constant of the organic compound is low in general, and accordingly, capacitance of the charge transportation layer 23 and the reading photoconductive layer 24 is reduced, and signal extraction efficiency at the time of reading thereof can be increased.

For the reading photoconductive layer 24, suitable is a photoconductive substance containing, as a main component, at least one of a-Se, Se—Te, Se—As—Te, metal-free phthalocyanine, metal phthalocyanine, magnesium phthalocyanine (MgPc), phase II of vanadyl phthalocyanine (VoPc), copper phthalocyanine (CuPc) and the like.

For the recording radiation-conductive layer 22, the photoconductive layer manufactured by the manufacturing method of the present invention is used. Specifically, the photoconductive layer manufactured by the manufacturing method of the present invention is the recording radiation-conductive layer.

Subsequently, a system using light for the purpose of reading an electrostatic latent image will be briefly described. FIG. 3 is a constitutional view schematically showing a recording/reading system (one formed by integrating an electrostatic latent image recording apparatus and an electrostatic latent image reading apparatus) using the radiation imaging panel 20. This recording/reading system is formed of the radiation imaging panel 20, a recording irradiation means 90, a power source 50, current detecting means 70, reading exposure means 92, and connecting means S1 and S2. The electrostatic latent image recording apparatus portion is formed of the radiation imaging panel 20, the power source 50, the recording irradiation means 90, and the connecting means S1. The electrostatic latent image reading apparatus portion is formed of the radiation imaging panel 20, the current detecting means 70, and the connecting means S2.

The conductive layer 21 of the radiation imaging panel 20 is connected to a negative electrode of the power source 50 through the connecting means S1, and moreover, is also connected to one end of the connecting means S2. One of the other ends of the connecting means S2 is connected to the current detecting means 70. The conductive layer 25 of the radiation imaging panel 20, a positive electrode of the power source 50 and the other of the other ends of the connecting means S2 are grounded. The current detecting means 70 is formed of a feedback resistor 70*b* and a detection amplifier 70*a* composed of an operational amplifier, and constitutes a so-called current/voltage conversion circuit.

An object 29 is placed on an upper surface of the conductive layer 21. The object 29 has a portion 29*a* which is transparent with respect to the radiation L1 and a shielding portion (light-shielding portion) 29*b* which does not have transparency. The recording irradiation means 90 evenly exposes and irradiates the object 29 with the radiation L1. The reading exposure means 92 scans and exposes the object 29 with the reading light L2 such as an infrared laser beam and light from an LED and an EL cell in a direction of the arrow illustrated in FIG. 3. It is desirable that the reading light L2 have a beam shape converging to a small diameter.

A process of recording the electrostatic latent image in the recording/reading system constituted as described above will be described below with reference to a charge model (FIG. 4). In FIG. 3, the connecting means S2 is switched to an open state (that is, the connecting means S2 is not connected to either the ground or the current detecting means 70), and the connecting means S1 is switched on to apply direct voltage Ed by the power source 50 between the conductive layer 21 and the conductive layer 25. Then, negative charges are charged from the power source 50 to the conductive layer 21, and positive charges are charged therefrom to the conductive layer 25 (refer to FIG. 4A). In this manner, an electric field is formed between the conductive layers 21 and 25 in the radiation imaging panel 20, parallel to the conductive layers 21 and 25.

Next, the object 29 is evenly exposed and irradiated with the radiation L1 from the recording irradiation means 90. The radiation L1 is transmitted through the transmitting portion 29*a* of the object 29, and further is transmitted through the conductive layer 21. The radiation-conductive layer 22 comes to exhibit the conductivity by receiving the radiation L1 which has been thus transmitted. This is understood by the following: the radiation-conductive layer 22 acts as a variable resistor which indicates a variable resistance value in accordance with a dose of the radiation L1. The resistance value depends on the following: charge pairs of electrons (negative charges) and holes (positive charges) are generated by the radiation L1. When the dose of the radiation L1 which has been transmitted through the object 29 is small, the radiation-conductive layer 22 indicates a large resistance value (refer to FIG. 4B). Note that the negative charges (−) and the positive charges (+), which are generated by the radiation L1, are shown by circling symbols − and + in the drawing.

The positive charges generated in the radiation-conductive layer 22 move through the radiation-conductive layer 22 toward the conductive layer 21 at high speed, and undergo charge recombination with the negative charges charged in the conductive layer 21 on an interface between the conductive layer 21 and the radiation-conductive layer 22. Then, the positive charges disappear (refer to FIGS. 4C and 4D). Meanwhile, the negative charges charged in the radiation-conductive layer 22 move through the radiation-conductive layer 22 toward the charge transportation layer 23. The charge transportation layer 23 acts as the insulator to charges of the same polarity as the charges charged in the conductive layer 21 (negative charges in this example). Accordingly, the negative charges which have moved through the radiation-conductive layer 22 stop at an interface between the radiation-conductive layer 22 and the charge transportation layer 23, and are accumulated at the interface (refer to FIGS. 4C and 4D). A quantity of the accumulated charges is determined by a quantity of the negative charges generated in the radiation-conductive layer 22, that is, by the dose of the radiation L1 which has been transmitted through the object 29.

Figure 4B:
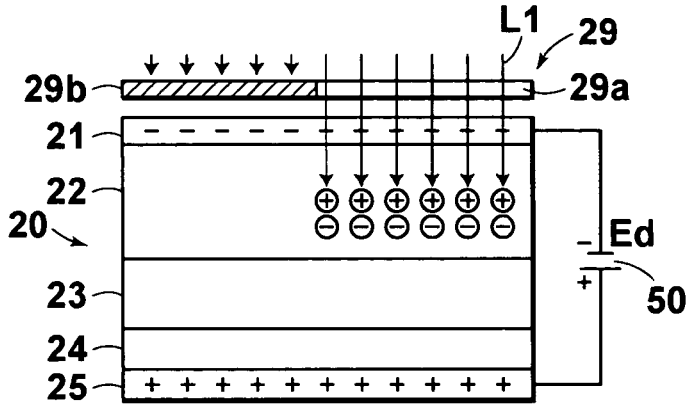
Figure 4C:
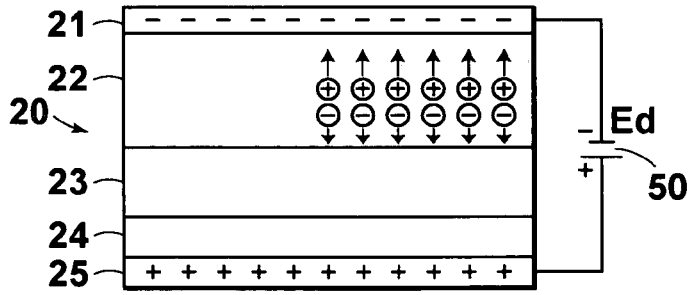
Figure 4D:
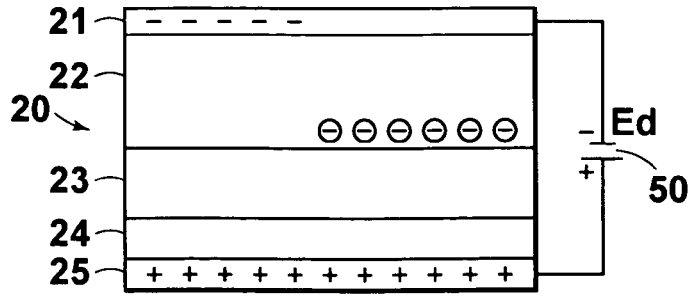

Meanwhile, the radiation L1 is not transmitted through the light-shielding portion 29*b* of the object 29, and accordingly, a portion of the radiation imaging panel 20, which is below the light-shielding portion 29*b*, does not cause any change (refer to FIGS. 4B to 4D). As described above, the object 29 is exposed and irradiated with the radiation L1, thus making it possible to accumulate charges in accordance with an image of the object at the interface between the radiation-conductive layer 22 and the charge transportation layer 23. Note that the image of the object, which is formed by the charges thus accumulated, is referred to as the electrostatic latent image.

Next, a process of reading the electrostatic latent image will be described with reference to a charge model (FIG. 5). The connecting means S1 is opened to stop a supply of the power source, the connecting means S2 is connected once to the ground side, and the conductive layers 21 and 25 of the radiation imaging panel 20 in which the electrostatic latent image is recorded are charged to the same potential, thereby rearranging the charges (refer to FIG. 5A). Thereafter, the connecting means S2 is connected to the side of the current detecting means 70.

When the conductive layer 25 side of the radiation imaging panel 20 is scanned and exposed with the reading light L2 by the reading exposure means 92, the reading light L2 is transmitted through the conductive layer 25, and the photoconductive layer 24 irradiated with the transmitted reading light L2 comes to exhibit the conductivity in accordance with the scanning and exposure. This phenomenon depends on the fact that pairs of positive and negative charges are generated by receiving irradiation of the reading light L2, as in the case where the above-described radiation-conductive layer 22 exhibits the conductivity because the pairs of positive and negative charges are generated by receiving the irradiation of the radiation L1 (refer to FIG. 5B). Note that, as in the recording process, the negative charges (−) and the positive charges (+), which are generated by the reading light L2, are shown by circling symbols − and + in the drawing.

Figure 5A:
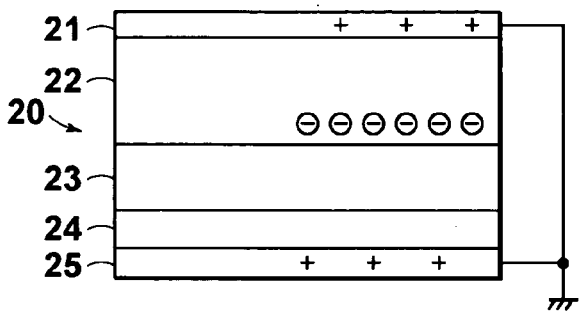
FIGS. 5A to 5D are views showing a process of reading the electrostatic latent image in the recording/reading system based on a charge model.
Figure 5B:
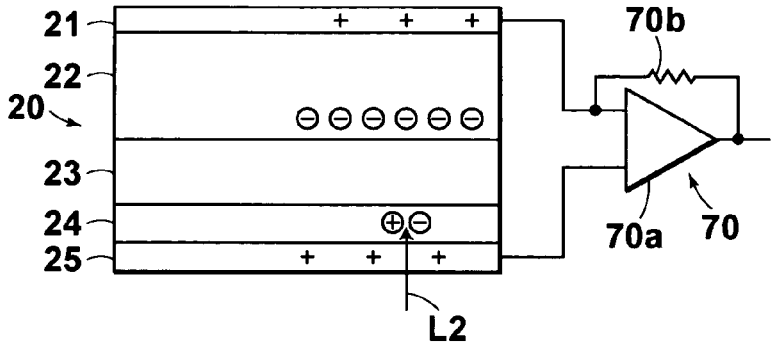
Figure 5C:
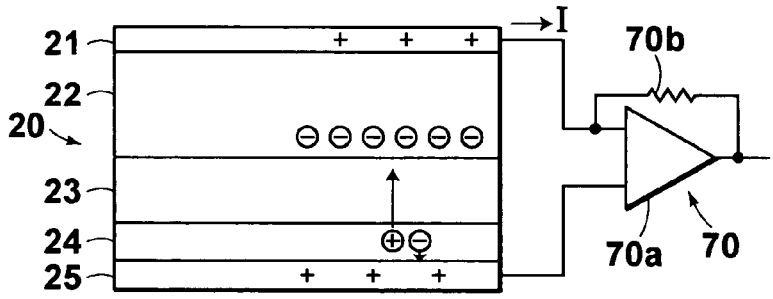
Figure 5D:
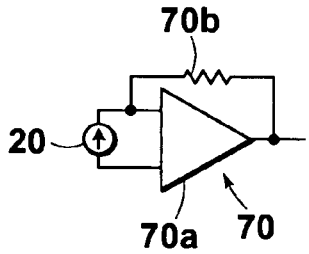

The charge transportation layer 23 acts as the conductor of the positive charges. Accordingly, the positive charges generated in the photoconductive layer 24 move rapidly through the charge transportation layer 23 in a manner of being attracted by the accumulated charges, and undergo the charge recombination with the accumulated charges on the interface between the radiation-conductive layer 22 and the charge transportation layer 23. Then, the positive charges disappear (refer to FIG. 5C). Meanwhile, the negative charges generated in the photoconductive layer 24 undergo the charge recombination with the positive charges of the conductive layer 25, and then disappear (refer to FIG. 5C). The photoconductive layer 24 is scanned and exposed with a sufficient quantity of light by the reading light L2, and the accumulated charges accumulated on the interface between the radiation-conductive layer 22 and the charge transportation layer 23, that is, the entire electrostatic latent image is caused to disappear by the charge recombination. The above-described fact that the charges accumulated in the radiation imaging panel 20 disappear means that a current I generated by the movement of the charges has flowed in the radiation imaging panel 20, and this state can be shown by an equivalent circuit as shown in FIG. 5D, in which the radiation imaging panel 20 is represented by a current source in which a quantity of current depends on a quantity of the accumulated charges.

As described above, the current flowing out of the radiation imaging panel 20 is detected while the radiation imaging panel 20 is being scanned and exposed with the reading light L2, thus making it possible to sequentially read the quantities of accumulated charges of the respective portions (corresponding to the pixels) scanned and exposed. In this manner, the electrostatic latent image can be read. Note that the above-described operation of detecting the radiation is described in Japanese Unexamined Patent Publication No. 2000-105297 and the like.

Figure 6:
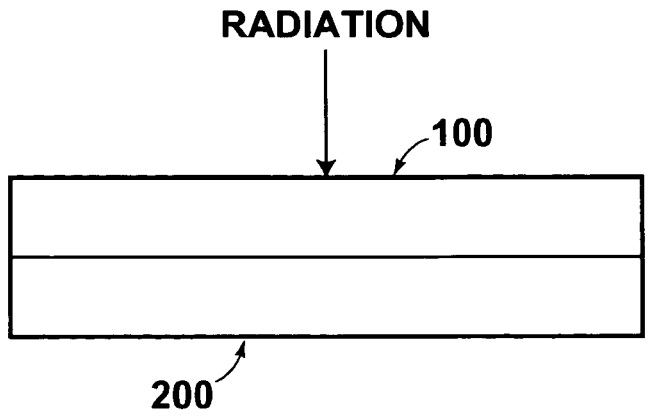
FIG. 6 is a schematic diagram showing a state where a radiation detection unit and an AMA substrate are united together.
Figure 7:
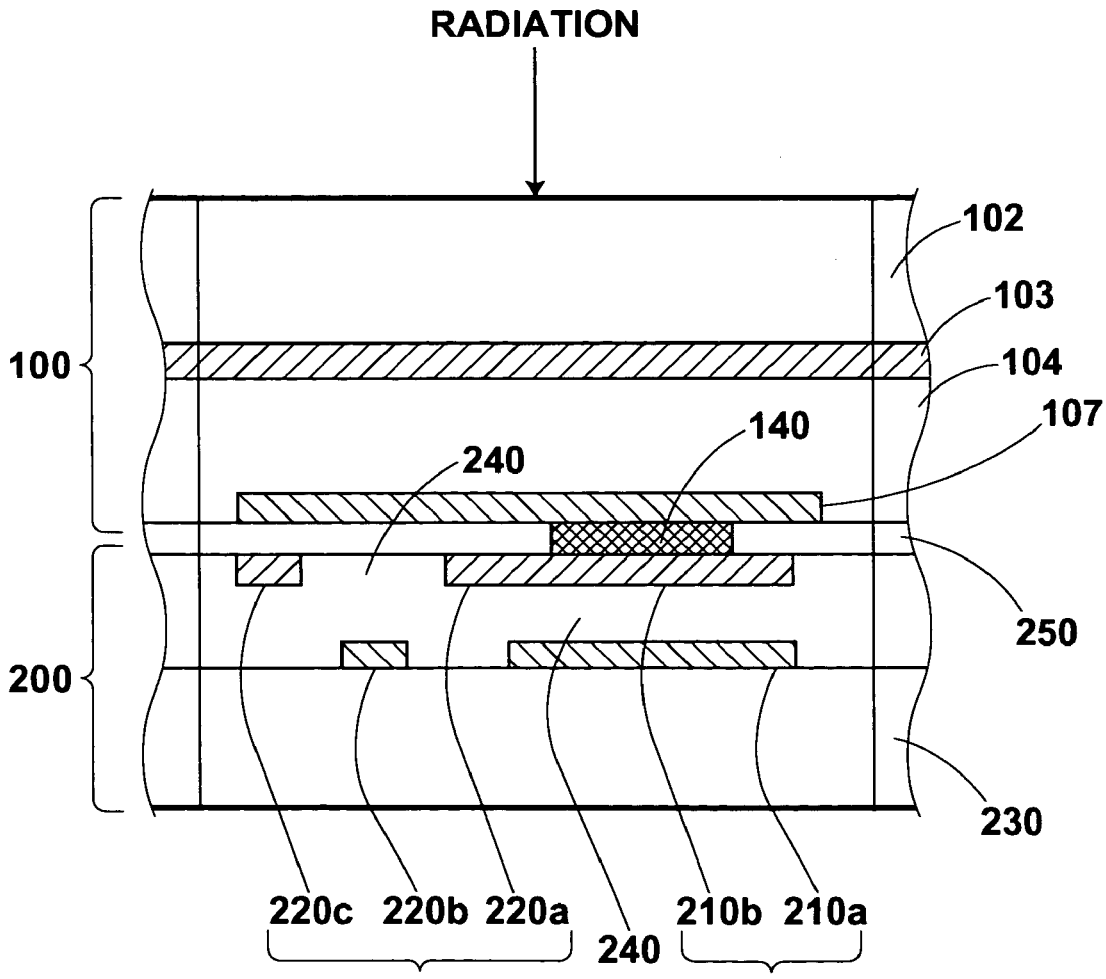
FIG. 7 is a cross-sectional view schematically showing a pixel portion of the radiation detection unit.

Next, a radiation imaging panel in accordance with the latter TFT system will be described. As shown in FIG. 6, the radiation imaging panel has a structure in which a radiation detection unit 100 and an active matrix array substrate (hereinafter, referred to as an AMA substrate) 200 are joined together. As shown in FIG. 7, broadly speaking, the radiation detection unit 100 has a constitution in which a common electrode 103 for applying a bias voltage, a photoconductive layer 104 which generates carriers as pairs of electrons and holes upon sensing the radiation to be detected, and a detection electrode 107 for collecting the carriers, are formed in a stacked manner in the above order from a radiation incident side. A radiation detection unit support 102 may be provided on the common electrode.

The photoconductive layer 104 is manufactured by the manufacturing method of the present invention. Each of the common electrode 103 and the detection electrode 107 is formed of a conductive material such as indium tin oxide (ITO), Au and Pt, for example. A hole implantation inhibiting layer and an electron implantation inhibiting layer may be added to the common electrode 103 and the detection electrode 107 in accordance with a polarity of the bias voltage.

Figure 8:
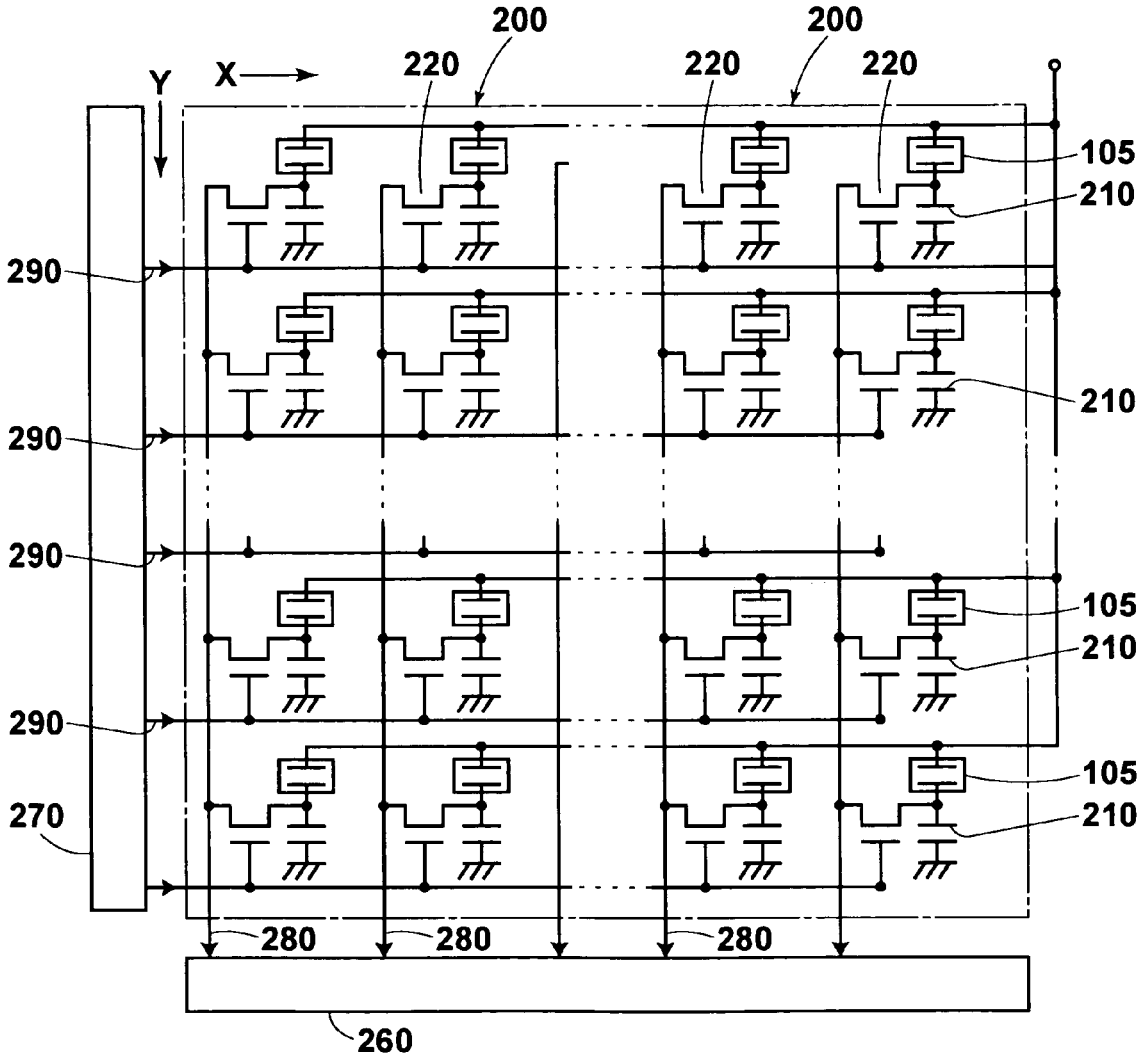
FIG. 8 is an electric circuit diagram showing an equivalent circuit of the AMA substrate.

Constitutions of the respective portions of the AMA substrate 200 will be briefly described. As shown in FIG. 8, in the AMA substrate 200, a capacitor 210 as a charge accumulation capacitor and a TFT 220 as a switching element are provided for each one of radiation detection unit 105 corresponding to the pixels. In the support 102, the radiation detection units 105 corresponding to the pixels are two-dimensionally arrayed in a matrix constitution of approximately 1000 to 3000 pieces in the longitudinal direction and approximately 1000 to 3000 pieces in the lateral direction in accordance with the necessary pixels. Moreover, also in the AMA substrate 200, the capacitors 210 and the TFTs 220, which are equal in number to the pixels, are two-dimensionally arrayed in a similar matrix constitution. Charges generated in the photoconductive layer are accumulated in the capacitors 210, and become an electrostatic latent image in accordance with the optical reading system. In the TFT method of the present invention, the electrostatic latent image generated by the radiation is held in the charge accumulation capacitors.

Specific constitutions of the capacitors 210 and the TFTs 220 in the AMA substrate 200 are as shown in FIG. 7. Specifically, an AMA substrate support 230 is an insulator. Moreover, a connection-side electrode 210*b* of the capacitor 210 and a source electrode 220*b* and drain electrode 220*c* of the TFT 220 are formed in a stacked manner above a ground-side electrode 210*a* of the capacitor 210 and a gate electrode 220*a* of the TFT 220, the ground-side electrode 210*a* and the gate electrode 220*a* being formed on a surface of the AMA substrate support 230, with an insulating film 240 interposed therebetween. In addition, the uppermost surface of the AMA substrate 200 is covered with a protecting insulating film 250. Furthermore, the connection-side electrode 210*b* and the source electrode 220*b* are interconnected to be one, and are formed simultaneously. For example, a plasma SiN film is used as the insulating film 240 constituting both of a capacitor insulating film of the capacitor 210 and a gate insulating film of the TFT 220. The AMA substrate 200 described above is manufactured by use of thin film formation techniques and microprocessing techniques which are used in producing liquid crystal display substrates.

Note that the photoconductive layer formed by the manufacturing method of the present invention may be joined to the AMA substrate in a manner such that a support which is a conductive film (ITO glass substrate, Al plate and the like) having high transparency to the X-rays is used as the common electrode and that a connection electrode is provided therebetween. Alternatively, the photoconductive layer may be formed on the AMA substrate, and the common electrode may be formed on the photoconductive layer. Note that, in the latter case, for the purpose of restricting damage to the AMA substrate, it is preferable to set the temperature of the AMA substrate within a range of 10° C. to 200° C., and more preferably, within a range of 100° C. to 200° C. In the case of forming the photoconductive layer on a support other than the AMA substrate in the former case, a heating treatment may be performed for the photoconductive layer after the film formation.

Subsequently, the joining of the radiation detection unit 100 and the AMA substrate 200 will be described. In a state where the detection electrode 107 and the connection-side electrode 210*b* of the capacitor 210 are aligned with each other, both of the substrates 100 and 200 are adhered by heating and pressurization to be bonded together while interposing therebetween an anisotropic conductive film (ACF) which contains conductive particles such as silver particles and has conductivity only in a thickness direction thereof. Thus, both of the substrates 100 and 200 are mechanically united together. Simultaneously, the detection electrode 107 and the connection-side electrode 210*b* are electrically connected to each other by a conductor portion 140 interposed therebetween.

Moreover, in the AMA substrate 200, a reading drive circuit 260 and a gate drive circuit 270 are provided. As shown in FIG. 8, the reading drive circuit 260 is connected to reading wires (reading address lines) 280 in the longitudinal (Y) direction, which interconnect the drain electrodes of the TFTs 220 belonging to the same column. Moreover, the gate drive circuit 270 is connected to reading lines (gate address lines) 290 in the lateral (X) direction, which interconnect the gate electrodes of the TFTs 220 belonging to the same row. Note that, though not shown, in the reading drive circuit 260, one preamplifier (charge-voltage converter) is connected to each of the reading wires 280. As described above, the reading drive circuit 260 and the gate drive circuit 270 are connected to the AMA substrate 200. However, one is also used, in which the reading drive circuit 260 and the gate drive circuit 270 are integrally molded in the AMA substrate 200 to achieve integration thereof.

Note that a radiation detection operation by a radiation imaging apparatus in which the above-described radiation detection unit 100 and AMA substrate 200 are joined and united together is described, for example, in Japanese Unexamined Patent Publication No. 11 (1999)-287862 and the like.

Examples of the method according to the present invention for manufacturing the photoconductive layer that constitutes the radiation imaging panel will be described below.

EXAMPLES

Example 1

Bismuth oxide ($Bi_2O_3$) powder and silicon oxide ($SiO_2$) powder were compounded with each other so that the molar ratio thereof became 6:1, and ball mill mixing was performed for an obtained compound in ethanol by using zirconium oxide balls. A mixture thus obtained was collected and dried, followed by temporal firing at 800° C. for 4 hours. In this manner, $Bi_{12}SiO_{20}$ powder was obtained by a solid phase reaction of the bismuth oxide and the silicon oxide. The $Bi_{12}SiO_{20}$ powder was milled in a mortar, and filtered through a mesh with a hole diameter of 150 μm or less. Thereafter, by using the zirconium oxide balls, the powder was milled and dispersed in ethanol by a ball mill. A mean particle diameter of powder thus obtained (hereinafter, referred to as BSO-1 powder) was approximately 3 μm. A crystal phase of the powder was observed by means of an X-ray analyzer (RINT-ULTIMA+: made by Rigaku Corporation). Then, the BSO-1 powder had a $Bi_{12}SiO_{20}$ single phase. Moreover, particles with a particle diameter ranging from 0.1 to 2 μm occupied 45 wt %.

On an Al substrate, the BSO-1 powder was formed into a photoconductive layer formed of $Bi_{12}SiO_{20}$ with a thickness of 200 μm by using the manufacturing apparatus shown in FIG. 1 under conditions where the substrate temperature was set at room temperature, Ar gas was used as the carrier gas, and a total gas flow rate was set at $1\times10^{-4}$ $m^3/s$.

Example 2

$Bi(NO)_3$ powder.$5H_2O$ was dissolved into a 10% nitric acid solution, and a 0.2 M solution was prepared (hereinafter, the solution is referred to as a B-1 solution). $Na_2SiO_3 9H_2O$ was dissolved into water, and a 0.2 M solution was prepared (hereinafter, the solution is referred to as an S-1 solution). The B-1 solution and the S-1 solution were mixed with each other in a ratio of 12:1, NaOH(5N) was added thereto while an obtained mixture was being agitated at 70° C. to adjust the pH thereof at 12, and thus a yellow deposit was obtained. Thereafter, the deposit was neutralized by nitric acid. A washing operation which washes the deposit with water and throws away supernatant water by centrifugal separation was repeated five times, the rest was collected and dried, and thus $Bi_{12}SiO_{20}$ powder particles with a mean particle diameter of 2 μm were obtained (hereinafter, referred to as BSO-2 powder). When a crystal phase of the powder was observed by means of the X-ray analyzer, the BSO-2 powder had a $Bi_{12}SiO_{20}$ single phase. Moreover, particles with a particle diameter ranging from 0.1 to 2 μm occupied 50 wt %. The BSO-2 powder was formed into a photoconductive layer formed of $Bi_{12}SiO_{20}$ by using the manufacturing apparatus shown in FIG. 1 under the same conditions as in Example 1.

Example 3

While the B-1 solution and the S-1 solution were being mixed in a ratio of 12:1 and agitated, 28% ammonia solution was added thereto, and a white deposit was obtained. A washing operation which washes the deposit with water and throws away supernatant water by centrifugal separation was repeated five times, and the rest was collected and dried, followed by firing at 800° C. in a muffle furnace for two hours. Thus, $Bi_{12}SiO_{20}$ powder particles with a mean particle diameter of 1 μm were obtained (hereinafter, referred to as BSO-3 powder). When a crystal phase of the powder was observed by means of the X-ray analyzer, the BSO-3 powder had a $Bi_{12}SiO_{20}$ single phase. Moreover, particles with a particle diameter ranging from 0.1 to 2 μm occupied 70 to 80 wt %. The BSO-3 powder was formed into a photoconductive layer formed of $Bi_{12}SiO_{20}$ by using the manufacturing apparatus shown in FIG. 1 under the same conditions as in Example 1.

Example 4

In the same procedure as in Example 3 except that the firing temperature in the muffle furnace in Example 3 was changed to 700° C., $Bi_{12}SiO_{20}$ powder particles with a mean particle diameter of 0.5 μm were obtained (hereinafter, referred to as BSO-4 powder). When a crystal phase of the powder was observed by means of the X-ray analyzer, the BSO-4 powder had a $Bi_{12}SiO_{20}$ single phase. Moreover, particles with a particle diameter ranging from 0.1 to 2 μm occupied 90 to 95 wt %. The BSO-4 powder was formed into a photoconductive layer formed of $Bi_{12}SiO_{20}$ by using the manufacturing apparatus shown in FIG. 1 under the same conditions as in Example 1.

Example 5

0.1 $dm^3$ of the B-1 solution of Example 2 and 0.1 $dm^3$ of a 0.6 M KI solution were simultaneously added to 0.1 $dm^3$ of a well agitated 0.001 M KI solution, and thus a black deposit was obtained. For the deposit, a washing operation which washes the deposit with water and throws away supernatant water by centrifugal separation was repeated three times, the rest was collected and dried, and thus $BiI_3$ powder particles with a mean particle diameter of approximately 0.5 μm, which had a disc shape with a mean circle diameter of 1 μm and a mean thickness of 0.1 μm were obtained (hereinafter, referred to as BI-1 powder). When a crystal phase of the powder was observed by means of the X-ray analyzer, the BI-1 powder had a $BiI_3$ single phase. Moreover, particles with a particle diameter ranging from 0.1 to 2 μm occupied 90 to 95 wt %. The BI-1 powder was formed into a photoconductive layer formed of $BiI_3$ by using the manufacturing apparatus shown in FIG. 1 under the same conditions as in Example 1.

Example 6

While the B-1 solution of Example 2 was being agitated at 70° C., NaOH (5N) was added thereto to adjust the pH thereof at 12, and thus a yellow deposit was obtained. Thereafter, the deposit was neutralized by nitric acid. For the deposit, a washing operation which washes the deposit with water and throws away supernatant water by centrifugal separation was repeated five times, the rest was collected and dried, and thus $Bi_2O_3$ powder particles with a mean particle diameter of 0.7 μm, which had a stick shape with a mean longitudinal diameter of 5 μm and a mean lateral diameter of 0.2 μm were obtained (hereinafter, referred to as BO-1 powder). When a crystal phase of the powder was observed by means of the X-ray analyzer, the BO-1 powder had a $Bi_2O_3$ single phase. Moreover, particles with a particle diameter ranging from 0.1 to 2 μm occupied 80 to 90 wt %. The BO-1 powder was formed into a photoconductive layer formed of $Bi_2O_3$ by using the manufacturing apparatus shown in FIG. 1 under the same conditions as in Example 1.

Example 7

Titanium peroxi citric acid ammonium tetrahydrate (TAS-Fine: made by Furuuchi Chemical Corporation) was dissolved into water, and a 0.2 M solution was prepared (hereinafter, the solution is referred to as a T-1 solution). The B-1 solution of Example 2 and the T-1 solution were mixed with each other in a ratio of 12:1, 28% ammonia solution was added thereto while an obtained mixture was being agitated, and thus a white deposit was obtained. A washing operation which washes the deposit with water and throws away supernatant water by centrifugal separation was repeated five times, the rest was collected and dried, followed by firing at 750° C. in the muffle furnace for two hours. Thus, $Bi_{12}TiO_{20}$ powder particles with a mean particle diameter of approximately 0.8 μm were obtained (hereinafter, referred to as BTO-1 powder). When a crystal phase of the powder was observed by means of the X-ray analyzer, the BTO-1 powder had a $Bi_{12}TiO_{20}$ single phase. Moreover, particles with a particle diameter ranging from 0.1 to 2 μm occupied 80 to 90 wt %. The BTO-1 powder was formed into a photoconductive layer formed of $Bi_{12}TiO_{20}$ by using the manufacturing apparatus shown in FIG. 1 under the same conditions as in Example 1.

Example 8

On an Al substrate, the BSO-4 powder of Example 4 was formed into a photoconductive layer formed of $Bi_{12}SiO_{20}$ with a thickness of 200 μm by using the manufacturing apparatus shown in FIG. 1 under conditions where the substrate temperature was set at 150° C., Ar gas was used as the carrier gas, and a total gas flow rate was set at $1\times10^{-4}$ $m^3/s$.

Example 9

A photoconductive layer formed of $Bi_{12}SiO_{20}$ was formed as in Example 8 except that the substrate temperature was set at 250° C.

Example 10

A photoconductive layer formed of $Bi_{12}SiO_{20}$ was formed as in Example 8 except that the substrate temperature was set at 350° C.

Comparative Example 1

The BSO-1 powder obtained in Example 1 and a polyester binder (Vylon 300: made by Toyobo Co., Ltd.) were mixed together at a weight ratio of 9:1 and dispersed into a methylethylketone solvent. An obtained mixture was coated on an Al substrate by a doctor blade method, followed by drying. Thus, a photoconductive layer formed of $Bi_{12}SiO_{20}$ with a film thickness of 200 μm was obtained.

Comparative Example 2

Figure 9:
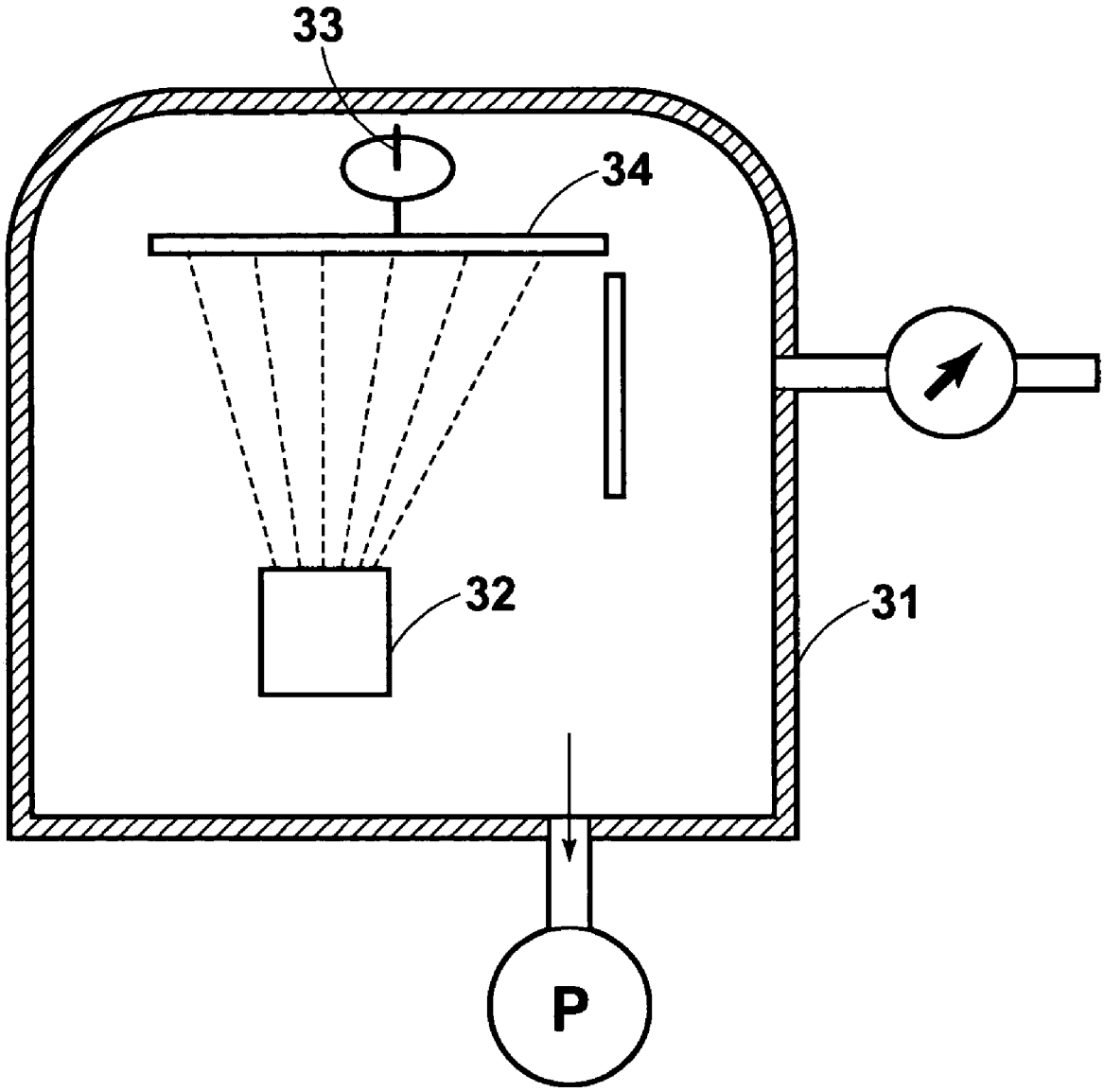
FIG. 9 is a schematic diagram of a vacuum evaporation apparatus.

In an evaporation source 32 in a vacuum evaporation apparatus as shown in FIG. 9 (which is formed in a manner such that the evaporation source 32 is placed opposite to an Al substrate 34 rotating about a shaft 33 in a vacuum chamber 31), the BSO-1 powder obtained in Example 1 was placed to fill an alumina crucible. Subsequently, the BSO-1 powder was evaporated onto the Al substrate 34 under conditions where the temperature of the crucible was set at 960° C. and a degree of vacuum was set at 0.001 Pa. When a crystal phase of a film thus obtained was observed by means of the X-ray analyzer, $Bi_2SiO_5$ (JCPDS number 36-0288) and $Bi_2O_3$ (JCPDS number 14-699) were mixed.

Reference Example

Single crystal of $Bi_{12}SiO_{20}$ (made by Fujian Castech Crystals, Inc. in China), which was subjected to 100-surface figuring, and had a size of 2 cm square and a thickness of 200 μm, was joined to an Al substrate by using a conductive paste "Dotite" (made by Fujikurakasei Co., Ltd.).

(Measurement of Sensitivity)

On each of the photoconductive layers obtained by Examples 1 to 10, Comparative examples 1 to 5, and Reference example, gold was sputtered as an upper electrode with a thickness of 60 nm. This was irradiated with 10 mR X-rays for 0.1 second under a condition where an X-ray photocurrent signal was at a voltage of 80 kV, and a photocurrent on a pulse generated under a condition where a voltage is applied thereto (applied voltage is applied so as to correspond to an electric field of 2.5 V/μm) was converted into voltage by a current amplifier, which was then measured by means of a digital oscilloscope. Based on an obtained current/time curve, the voltage was integrated within a range of the X-ray irradiation time, and measured as an amount of generated charges.

Results are shown in Table 1. Note that sensitivities in Table 1 are represented by relative values by taking as 100 the sensitivity of Comparative Example 1, which was measured by the above-described method.

TABLE 1

| | Photoconductive material | Mean particle diameter (μm) | Particle diameter (μm)/Ratio (wt %) | Manufacturing method | Relative sensitivity | Substrate temperature |
|---|---|---|---|---|---|---|
| Example 1 | $Bi_{12}SiO_{20}$ | 3 | 0.1 to 2/45 | AD method | 4700 | Room temperature |
| Example 2 | $Bi_{12}SiO_{20}$ | 2 | 0.1 to 2/50 | AD method | 6500 | Room temperature |
| Example 3 | $Bi_{12}SiO_{20}$ | 1 | 0.1 to 2/70 to 80 | AD method | 7200 | Room temperature |
| Example 4 | $Bi_{12}SiO_{20}$ | 0.5 | 0.1 to 2/90 to 95 | AD method | 7500 | Room temperature |
| Example 5 | $BiI_3$ | 0.5 | 0.1 to 2/90 to 95 | AD method | 3200 | Room temperature |
| Example 6 | $Bi_2O_3$ | 0.7 | 0.1 to 2/80 to 90 | AD method | 6700 | Room temperature |
| Example 7 | $Bi_{12}TiO_{20}$ | 0.8 | 0.1 to 2/80 to 90 | AD method | 7200 | Room temperature |
| Example 8 | $Bi_{12}SiO_{20}$ | 0.5 | 0.1 to 2/90 to 95 | AD method | 7800 | 150° C. |
| Example 9 | $Bi_{12}SiO_{20}$ | 0.5 | 0.1 to 2/90 to 95 | AD method | 7900 | 250° C. |
| Example 10 | $Bi_{12}SiO_{20}$ | 0.5 | 0.1 to 2/90 to 95 | AD method | 8100 | 300° C. |
| Comparative example 1 | $Bi_{12}SiO_{20}$ | 3 | 0.1 to 2/45 | Coating method | 100 | — |
| Comparative example 2 | $Bi_{12}SiO_{20}$ | — | — | Vacuum evaporation method | 300 | — |
| Comparative example 3 | $BiI_3$ | 1 | 0.1 to 2/90 to 95 | Coating method | 100 | — |
| Comparative example 4 | $Bi_2O_3$ | 0.7 | 0.1 to 2/80 to 90 | Coating method | 100 | — |
| Comparative example 5 | $Bi_{12}TiO_{20}$ | 0.8 | 0.1 to 2/80 to 90 | Coating method | 100 | — |
| Reference example | $Bi_{12}SiO_{20}$ | — | — | Single crystal | 9200 | — |

Comparative Example 3

A photoconductive layer formed of $BiI_3$ was obtained as in Comparative Example 1 except that the BI-1 powder obtained in Example 5 was used.

Comparative Example 4

A photoconductive layer formed of $BiI_3$ was obtained as in Comparative Example 1 except that the BO-1 powder obtained in Example 6 was used.

Comparative Example 5

A photoconductive layer formed of $Bi_{12}TiO_{20}$ was obtained as in Comparative Example 1 except that the BTO-1 powder obtained in Example 7 was used.

As is apparent from Table 1, when comparing the photoconductive layers produced by the manufacturing method of the present invention with the photoconductive layers produced by the coating method, the photoconductive layers formed of $Bi_{12}SiO_{20}$ according to the present invention exhibited sensitivities 47 to 75 times as high as that of the photoconductive layer according to the coating method (Examples 1 to 4, Comparative example 1). The photoconductive layer formed of $BiI_3$ according to the present invention exhibited sensitivity 32 times as high as that of the photoconductive layer according to the coating method (Example 5, Comparative example 3). The photoconductive layer formed of $Bi_2O_3$ according to the present invention exhibited sensitivity 67 times as high as that of the photoconductive layer according to the coating method (Example 6, Comparative example 4). The photoconductive layer formed of $Bi_{12}TiO_{20}$ according to the present invention exhibited sensitivity 72 times as high as that of the photoconductive layer according to the coating method (Example 7, Comparative example 5).

The photoconductive layer formed of $Bi_{12}SiO_{20}$, which was produced by the vacuum evaporation method, was a film in which $Bi_2SiO_5$ and $Bi_2O_3$ are mixed, and did not have a single phase of $Bi_{12}SiO_{20}$. Moreover, when comparing the photoconductive layers produced by the manufacturing method of the present invention with the photoconductive layer produced by the vacuum evaporation method, the photoconductive layers formed of the single-phase $Bi_{12}SiO_{20}$ according to the present invention exhibited sensitivities 16 to 25 times as high as that of the photoconductive layer according to the vacuum evaporation method (Examples 1 to 4, Comparative example 2).

A space filling factor of the film formed of $Bi_{12}SiO_{20}$, which was manufactured by each of Examples 1 to 4, was obtained from a ratio of a density of $Bi_{12}SiO_{20}$ to a bulk density calculated by dividing a weight of $Bi_{12}SiO_{20}$ on the substrate by a total volume of the film. Then, the space filling factor in each of Examples 1 to 4 was 80% or more, was increased from Example 1 to Example 4, and reached 87% in Example 4. The particles which have collided due to the carrier gas joined together owing to the impact of the collision, and thus a considerably dense film was formed. It is conceived possible to obtain such high sensitivity because the material particles of the photoconductive layer are deposited densely on the substrate as described above. A density in Comparative Example 1 was obtained by a volume of $Bi_{12}SiO_{20}$/(volume sum of $Bi_{12}SiO_{20}$ and binder)×100 because the binder exists. A theoretical space filling factor calculated from the weight ratio on the assumption that there is no void in the film was 52%, and a value obtained by the above-described expression was 45%.

Moreover, as shown in Examples 8 to 10, higher sensitivity was obtained when the temperature of the substrate in the case of depositing the material particles of the photoconductive layer was higher than room temperature. This is conceived as follows: Specifically, the space filling factor of the film formed of $Bi_{12}SiO_{20}$, which was manufactured by each of Examples 8 to 10, was 90% or more, which was higher than 87% in Example 4 where the photoconductive layer was formed at room temperature. The space filling factor was increased from Example 8 to Example 10, and the sensitivity was improved following such an increase.

Note that, while the photoconductive layer using the single crystal of $Bi_{12}SiO_{20}$ was shown as the Reference Example, an amount of X-ray photocurrent thereof is increased because impurities causing lattice defects are included in an extremely small amount in the single crystal as described above. It was possible for the photoconductive layer manufactured by the manufacturing method of the present invention to increase the sensitivity thereof nearly to that of the photoconductive layer of the Reference Example.

As described above, in the method for manufacturing the photoconductive layer according to the present invention, the material particles of the photoconductive layer are mixed with the carrier gas, accelerated and injected by the carrier gas, and deposited on the substrate, thereby being formed into the film. Accordingly, it is possible to obtain a dense film body having the same composition as that of the material particles. Therefore, an effect of inhibiting the movement of the generated charges, which is caused by the binder, is restricted, thus making it possible to enhance the sensitivity.

Moreover, it becomes possible to manufacture the photoconductive layer, whatever the type of material constituting the photoconductive layer may be. Furthermore, it is possible to cope with a request for the area enlargement of the photoconductive layer. In addition, the manufacturing costs of the photoconductive layer can be restricted more than in the vacuum evaporation method and the single crystal method, thus making it possible to manufacture the X-ray imaging panel at low cost.

What is claimed is:

1. A method for manufacturing a photoconductive layer that constitutes a radiation imaging panel which records radiation image information as an electrostatic latent image, wherein material particles of the photoconductive layer are mixed with carrier gas, accelerated and injected by the carrier gas, and deposited on a substrate, thereby being formed into a film;

wherein the photoconductive layer is formed of $Bi_{12}MO_{20}$ (where M is at least one of Ge, Si and Ti);

wherein a particle diameter distribution of the material particles of the photoconductive layer is set so that particles with a particle diameter of 0.1 to 2 μm occupy 70 wt % or more; and wherein the temperature of the substrate when the material particles of the photoconductive layer are deposited is 100° C. to 300° C.

* * * * *